US011104862B2

(12) United States Patent
Watanabe

(10) Patent No.: US 11,104,862 B2
(45) Date of Patent: Aug. 31, 2021

(54) GREASE COMPOSITION AND USE OF GREASE COMPOSITION

(71) Applicant: IDEMITSU KOSAN CO., LTD., Chiyoda-ku (JP)

(72) Inventor: Go Watanabe, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/634,439

(22) PCT Filed: Dec. 20, 2018

(86) PCT No.: PCT/JP2018/046989

§ 371 (c)(1),
(2) Date: Jan. 27, 2020

(87) PCT Pub. No.: WO2019/131437

PCT Pub. Date: Jul. 4, 2019

(65) Prior Publication Data

US 2020/0208075 A1 Jul. 2, 2020

(30) Foreign Application Priority Data

Dec. 27, 2017 (JP) ..... JP2017-252441

(51) Int. Cl.

| | |
|---|---|
| ***C10M 171/02*** | (2006.01) |
| ***C10M 169/06*** | (2006.01) |
| *C10M 117/02* | (2006.01) |
| *C10M 135/06* | (2006.01) |
| *C10M 137/10* | (2006.01) |
| *C10N 10/02* | (2006.01) |
| *C10N 20/02* | (2006.01) |
| *C10N 40/04* | (2006.01) |

(52) U.S. Cl.
CPC ..... *C10M 171/02* (2013.01); *C10M 169/06* (2013.01); *C10M 117/02* (2013.01); *C10M 135/06* (2013.01); *C10M 137/10* (2013.01); *C10M 2219/024* (2013.01); *C10M 2219/08* (2013.01); *C10M 2219/106* (2013.01); *C10M 2290/10* (2013.01); *C10N 2010/02* (2013.01); *C10N 2020/02* (2013.01); *C10N 2040/04* (2013.01)

(58) Field of Classification Search
CPC ..... C10M 171/02; C10M 169/06; C10M 117/02; C10M 135/06; C10M 137/10; C10M 2219/024; C10M 2219/08; C10M 2219/106; C10M 2290/10; C10M 2219/022; C10M 2223/043; C10M 2223/049; C10M 2223/047; C10M 2219/066; C10M 2205/026; C10M 2223/045; C10M 2219/082; C10M 2203/1025; C10M 2207/1265; C10N 2050/10; C10N 2010/02; C10N 2020/02; C10N 2040/04; C10N 2030/06; C10N 2040/02; C10N 2030/43; C10N 2030/42
See application file for complete search history.

(56) References Cited

U.S. PATENT DOCUMENTS

2012/0098269 A1* 4/2012 Fujinami ..... F16C 33/6633 290/55
2013/0012416 A1* 1/2013 Fujinami ..... C10M 169/02 508/154

FOREIGN PATENT DOCUMENTS

| | | | |
|---|---|---|---|
| JP | 2000-230188 | A | 8/2000 |
| JP | 2016-14108 | A | 1/2016 |
| JP | 2017-133154 | A | 8/2017 |
| WO | WO 2010/150726 | A1 | 12/2010 |
| WO | WO 2018/092806 | A1 | 5/2018 |

OTHER PUBLICATIONS

International Search Report dated Feb. 12, 2019 in PCT/JP2018/046989 filed Dec. 20, 2018, 3 pages.

* cited by examiner

*Primary Examiner* — Taiwo Oladapo
(74) *Attorney, Agent, or Firm* — Oblon, McClelland, Maier & Neustadt, L.L.P.

(57) ABSTRACT

Provided is a grease composition which contains (A) a mixed base oil containing (A1) a low-viscosity base oil having a kinematic viscosity at 40° C. of 10 to 50 $mm^2/s$ and (A2) a high-viscosity base oil having a kinematic viscosity at 40° C. of 200 to 700 $mm^2/s$, (B) a lithium-based thickener and (C) a polymer having a kinematic viscosity at 100° C. of 1,000 to 100,000 $mm^2/s$, and has an apparent viscosity at −10° C., as measured according to JIS K2220:2013 and at a shear rate of 10 $s^{-1}$, of 50 to 250 mPa·s. The grease composition is excellent in pumpability and is also excellent in wear resistance under poor lubrication conditions.

11 Claims, No Drawings

GREASE COMPOSITION AND USE OF GREASE COMPOSITION

RELATED APPLICATION

This application is a national stage entry of PCT/JP2018/046989, filed Dec. 20, 2018, which claims priority of Japanese Patent Application No. 2017-252441, filed Dec. 27, 2017, which are incorporated by reference in their entirety.

TECHNICAL FIELD

The present invention relates to a grease composition and a method for using the grease composition.

BACKGROUND ART

In various machines, grease may be used in lubrication parts such as bearings, slide parts and joint parts.

For example, construction machines and mining machines such as hydraulic shovels are equipped with a slewing mechanism for swirling an upper revolving superstructure or a mechanism for operating a boom, an arm or a packet, on a frame that connects right and left lower traveling bodies.

Grease is also used in such a sliming mechanism of hydraulic shovels (for example, see PTL 1).

CITATION LIST

Patent Literature

PTL 1: JP 2017-133154 A

SUMMARY OF INVENTION

Technical Problem

A slewing mechanism of excavation machines such as large-size hydraulic shovels to be used in mining sites in mines and others has a narrow lubrication route and may undergo serious rolling slip in operation, and therefore tends to be in poor lubrication. In addition, in mining sites in mines and others, powdery dust may mix in grease to detract from exudation of base oil from grease, therefore readily providing a state of poorer lubrication.

To that effect, under the condition of readily providing a state of poorer lubrication, grease excellent in wear resistance is desired.

On working machines such as hydraulic shovels, a centralized lubrication system for feeding grease may be mounted. Accordingly, grease excellent in pumpability is also desired.

An object of the present invention is to provide a grease composition excellent in pumpability and also excellent in wear resistance under poor lubrication conditions and to provide a method of using the grease composition.

Solution to Problem

The present inventors have found that a grease composition containing a specific mixed base oil and a specific polymer as well as a lithium-based thickener and having an apparent viscosity controlled to fall within a specific range can solve the above-mentioned problems, and have completed the present invention.

Specifically; the present invention relates to the following [1] and [2].

[1] A grease composition, which contains (A) a mixed base oil containing (A1) a low-viscosity base oil having a kinematic viscosity at 40° C. of 10 to 50 $mm^2/s$ and (A2) a high-viscosity base oil having a kinematic viscosity at 40° C. of 200 to 700 $mm^2/s$, (B) a lithium-based thickener and (C) a polymer having a kinematic viscosity at 100° C. of 1,000 to 100,000 $mm^2/s$, and has an apparent viscosity at −10° C., as measured according to PIIS K2220:2013 and at a shear rate of 10 $s^{-1}$, of 50 to 250 mPa·s.

[2] A method for using the grease composition of the above [1], wherein the grease composition is used in a clewing mechanism of a construction machine equipped with a centralized lubrication system or a mining machine equipped with a centralized lubrication system.

Advantageous Effects of Invention

The grease composition of the present invention is excellent in pumpability and is also excellent in wear resistance under poor lubrication conditions.

DESCRIPTION OF EMBODIMENTS

Embodiment of Grease Composition of the Invention

The grease composition of the present invention contains (A) a mixed base oil containing (A1) a low-viscosity base oil having a kinematic viscosity at 40° C. of 10 to 50 $mm^2/s$ and (A2) a high-viscosity base oil having a kinematic viscosity at 40° C. of 200 to 700 $mm^2/s$, (B) a lithium-based thickener and (C) a polymer having a kinematic viscosity at 100° C. of 1,000 to 100,000 $mm^2/s$.

With that, the grease composition of the present invention has an apparent viscosity at −10° C. of 50 to 250 mPa·s.

The present inventors have made assiduous studies about a grease composition excellent in pumpability and also excellent in wear resistance even under poor lubrication conditions. As a result, the present inventors have found that a grease composition having the above-mentioned constitution and having a specific apparent viscosity at −10° C. as above can better exudation of a base oil from the grease composition and can better penetration of the base oil into a lubrication surface, while securing pumpability of the grease composition, and further can sufficiently secure wear resistance, and accordingly can exhibit sufficiently excellent wear resistance even under poor lubrication conditions. Moreover, the present inventors have further found that even when powdery dust has mixed in grease, exudation of a base oil from grease can be bettered to sufficiently secure excellent wear resistance even in a state to be readily into poor lubrication.

On the other hand, the present inventors have known that a grease composition not containing the polymer (C) and having an apparent viscosity at −10° C. that oversteps the above range is poor in both pumpability and wear resistance under poor lubrication conditions.

When the apparent viscosity at −10° C. of the grease composition is controlled to fall within the above range, the grease composition can still secure pumpability even when used in low-temperature environments during winter season, etc.

Here, from the viewpoint of more bettering the pumpability of the grease composition of one embodiment of the present invention and from the viewpoint of more bettering the wear resistance thereof under poor lubrication conditions, the apparent viscosity at −10° C. of the grease composition is preferably 60 to 250 mPa·s, more preferably 60 to 230 mPa·s, even more preferably 80 to 210 mPa·s, further more preferably 100 to 200 mPa·s.

In this description, the apparent viscosity at −10° C. is a value measured at a shear rate of 10 $s^{-1}$ and according to JIS K2220:2013.

In the following description, "mixed base oil. (A)", "lithium-based thickener (B)", and "polymer (C)" may also be referred to as "component (A)", "component (B)" and "component (C)", respectively.

The grease composition of one embodiment of the present invention may contain any other component than the components (A), (B) and (C) within a range not detracting from the advantageous effects of the present invention.

The grease composition of one embodiment of the present invention preferably contains, as the other components than the above-mentioned components (A), (B) and (C), an organic zinc compound (D) and/or an extreme pressure agent (E).

In the following description, "organic zinc compound (D)" and "extreme pressure agent (E)" may also be referred to as "component (D)" and "component (E)", respectively.

In the grease composition of one embodiment of the present invention, the total content of the components (A), (B) and (C) is, based on the total amount (100% by mass) of the grease composition, preferably 50% by mass or more, more preferably 60% by mass or more, even more preferably 70% by mass or more, further more preferably 80% by mass or more.

Also in the grease composition of one embodiment of the present invention, the total content of the components (A), (B), (C) and (D) is, based on the total amount (100% by mass) of the grease composition, preferably 60% by mass or more, more preferably 70% by mass or more, even more preferably 80% by mass or more, further more preferably 90% by mass or more.

Further, in the grease composition of one embodiment of the present invention, the total content of the components (A), (B), (C) and (E) is, based on the total amount (100% by mass) of the grease composition, preferably 60% by mass or more, more preferably 70% by mass or more, even more preferably 80% by mass or more, further more preferably 90% by mass or more.

Also in the grease composition of one embodiment of the present invention, the total content of the components (A), (B), (C), (D) and (E) is, based on the total amount (100% by mass) of the grease composition, preferably 60 to 100% by mass or more, more preferably 70 to 100% by mass or more, even more preferably 80 to 100% by mass or more, further more preferably 90 to 100% by mass or more.

The components to be blended in the grease composition of the present invention are described below.

Mixed Base Oil (A)

The grease composition of the present invention contains a mixed base oil [A].

The mixed base oil (A) contains (A1) a low-viscosity base oil having a kinematic viscosity at 40° C. of 10 to 50 $mm^2/s$ and (A2) a high-viscosity base oil having a kinematic viscosity at 40° C. of 200 to 700 $mm^2/s$.

Containing the mixed base oil (A), the grease composition of the present invention can control the apparent viscosity thereof to fall within a predetermined range. In addition, containing the mixed base oil (A), the grease composition of the present invention can better the pumpability thereof and can also better the wear resistance thereof under poor lubrication conditions.

The kinematic viscosity at 40° C. of the base oil means a value measured according to JIS K2283:2000.

In the grease composition of one embodiment of the present invention, the content of the mixed base oil (A) is, based on the total amount (100% by mass) of the grease composition, preferably 50 to 95% by mass, more preferably 60 to 90% by mass, even more preferably 65 to 85% by mass, further more preferably 70 to 80% by mass.

As to the low-viscosity base oil (A1), from the viewpoint of more readily controlling the apparent viscosity of the grease composition, from the viewpoint of more bettering the pumpability of the grease composition, and from the viewpoint of more bettering the wear resistance thereof under poor lubrication conditions, the kinematic viscosity at 40° C. thereof is preferably 10 to 40 $mm^2/s$, more preferably 15 to 40 $mm^2/s$, even more preferably 20 to 35 $mm^2/s$.

As to the high-viscosity base oil (A2), from the same viewpoints, the kinematic viscosity at 40° C. thereof is preferably 200 to 600 $mm^2/s$, more preferably 250 to 550 $mm^2/s$, even more preferably 300 to 500 $mm^2/s$.

As the low-viscosity base oil (A1) and the high-viscosity base oil (A2) for use herein, at least one or more selected from mineral oils and synthetic oils satisfying the kinematic viscosity at 40° C. thereof are selected.

Examples of the mineral oils include paraffin-base mineral oils, intermediate-base mineral oils and naphthene-base mineral oils obtained through ordinary purification such as solvent purification and hydrogenation purification; and wax-isomerized oils produced through isomerization of wax such as wax produced through Fischer-Tropsch synthesis (gas to liquid wax) and mineral oil-base wax; and bright stock of a high-viscosity base oil produced through solvent deasphalting, solvent extraction, solvent dewaxing and hydrorefining of reduced-pressure distillation residues of crude oils.

Examples of the synthetic oils include hydrocarbon-based synthetic oils and ether-based synthetic oils. The hydrocarbon-based synthetic oils include α-olefin oligomers such as polybutene, polyisobutylene, 1-octene oligomer, 1-decene oligomer, and ethylene-propylene copolymer and hydrides thereof, and alkylbenzenes, and alkylnaphthalenes. The ether-based synthetic oils include polyoxyalkylene glycols and polyphenyl ethers.

One alone or two or more kinds of these mineral oils and synthetic oils may be used either singly or as combined. A combination of two or more kinds thereof includes a combination of one or more mineral oils and one or more synthetic oils.

From the viewpoint of more bettering the pumpability and the wear resistance under poor lubrication conditions of the grease composition in a broader temperature range, the low-viscosity base oil (A1) preferably has a viscosity index of 110 or more, more preferably 120 or more, even more preferably 130 or more.

From the same viewpoint, the high-viscosity base oil (A2) preferably has a viscosity index of 80 or more, more preferably 90 or more, even more preferably 100 or more.

In this description, the viscosity index means a value determined according to JIS K2283:2000.

The ratio by mass of the low-viscosity base oil (A1) to the high-viscosity base oil (A2) [(A1)/(A2)] is, from the viewpoint of more readily controlling the apparent viscosity of the grease composition, from the viewpoint of more bettering the pumpability of the grease composition and from the viewpoint of more bettering the wear resistance under poor lubrication conditions thereof, preferably 1/5 to 10/1, more preferably 1/2 to 10/1, even more preferably 1/2 to 5/1, further more preferably 1/2 to 2/1.

The mixed base oil containing the low-viscosity base oil (A1) and the high-viscosity base oil (A2) may contain any other base oil than the low-viscosity base oil (A1) and the high-viscosity base oil (A2).

From the viewpoint of more readily controlling the apparent viscosity of the grease composition, from the viewpoint of more bettering the pumpability of the grease composition and from the viewpoint of more bettering the wear resistance under poor lubrication conditions thereof, the content ratio of the low-viscosity base oil (A1) and the high-viscosity base oil (A2) relative to the total amount of the mixed base oil (A) [(content of low-viscosity base oil (A1)+content of high-viscosity base oil (A2)/total amount of mixed base oil (A)] is preferably 75 to 100% by mass, more preferably 90 to 100% by mass, even more preferably 95 to 100% by mass.

Lithium-Based Thickener (B)

The grease composition of the present invention contains a lithium-based thickener (B).

In the grease composition of one embodiment of the present invention, the content of the lithium-based thickener is, based on the total amount (100% by mass) of the grease composition, preferably 0.5 to 25% by mass, more preferably 1 to 20% by mass, even more preferably 3 to 15% by mass, further more preferably 5 to 10% by mass.

When the content of the lithium-based thickener (B) is 0.5% by mass or more, the grease composition can be readily kept greasy. When the content of the lithium-based thickener (B) is 25% by mass or less, the grease composition can better the pumpability thereof.

The lithium-based thickener (B) includes a lithium soap and a lithium complex soap.

Among these, from the viewpoint of more bettering the pumpability of the grease composition and from the viewpoint of more bettering the wear resistance thereof under poor lubrication conditions, a lithium soap is preferred.

For examples, a carboxylic acid or an ester thereof and lithium hydroxide are prepared as starting materials, and the lithium-based thickener (B) can be obtained by saponifying the carboxylic acid or an ester thereof with lithium hydroxide.

Specifically, the lithium-based thickener (B) can be produced by adding a carboxylic acid or an ester thereof and lithium hydroxide to a mixed base oil (A), or a low-viscosity base oil (A1) or a high-viscosity base oil (A2), and saponifying them in the base oil.

The carboxylic acid includes a crude fatty acid prepared by hydrolyzing fats and oils and removing glycerin therefrom, a monocarboxylic acid such as stearic acid, a monohydroxycarboxylic acid such as 12-hydroxystearic acid, a dibasic acid such as azelaic acid, and an aromatic carboxylic acid such as terephthalic acid, salicylic acid and benzoic acid.

One alone or two or more kinds thereof may be used either singly or as combined.

In this description, a lithium complex soap is a soap prepared by using, as carboxylic acids, both a fatty acid such as stearic acid, oleic acid or palmitic acid and/or a hydroxyfatty acid having 12 to 24 carbon atoms and having one or more hydroxyl groups in the molecule (carboxylic acid A), and an aromatic carboxylic acid and/or an aliphatic dicarboxylic acid having 2 to 12 carbon atoms (carboxylic acid B).

The lithium-based thickener (B) is preferably a simple lithium soap or a lithium complex soap containing, as a carboxylic acid to be a starting material, a hydroxycarboxylic acid having 12 to 24 carbon atoms, more preferably a simple lithium soap or a lithium complex soap containing a hydroxycarboxylic acid having 16 to 20 carbon atoms, even more preferably a simple lithium soap or a lithium complex soap containing 12-hydroxystearic acid, further more preferably a simple lithium soap containing 12-hydroxystearic acid.

In the case of a lithium complex soap, as a carboxylic acid to be a starting material, an aromatic carboxylic acid and/or an aliphatic dicarboxylic acid having 2 to 12 carbon atoms can be used in addition to the above-mentioned hydroxycarboxylic acid having 12 to 24 carbon atoms.

The aromatic carboxylic acid includes benzoic acid, phthalic acid, isophthalic acid, terephthalic acid, trimellitic acid, pyromellitic acid, salicylic acid and p-hydroxybenzoic acid.

The aliphatic dicarboxylic acid having 2 to 12 carbon atoms includes azelaic acid, sebacic acid, oxalic acid, malonic acid, succinic acid, adipic acid, pimellic acid, suberic acid, undecane-diacid, and dodecane-diacid.

Among the aromatic carboxylic acids and the aliphatic dicarboxylic acid having 2 to 12 carbon atoms exemplified above, azelaic acid is preferred.

Polymer (C)

The grease composition of the present invention contains (C) a polymer having a kinematic viscosity at 100° C. of 1,000 to 100,000 $mm^2/s$.

Containing the polymer (C), the apparent viscosity of the grease composition can be controlled to fall within a predetermined range. Also containing the polymer (C), the pumpability of the grease composition can be bettered and the wear resistance thereof under poor lubrication conditions can also be bettered.

In the case where the grease composition (C) does not contain the polymer (C), the grease composition cannot secure pumpability. In addition, in the case, the grease composition cannot also secure wear resistance under poor lubrication conditions.

In the grease composition of one embodiment of the present invention, the content of the polymer (C) is, based on the total amount of the grease composition, preferably 1 to 20% by mass, more preferably 5 to 15% by mass, even more preferably 7 to 13% by mass.

The polymer (C) is, for example, liquid polymer or a solid polymer soluble in the mixed base oil (A).

Specifically, examples thereof include a poly(meth)acrylate and a polyolefin, and one or more of these may be used. Among these, a polyolefin is preferred.

In the grease composition of one embodiment of the present invention, from the viewpoint of more readily controlling the apparent viscosity, from the viewpoint of more bettering the pumpability and from the viewpoint of more bettering the wear resistance under poor lubrication conditions, the kinematic viscosity at 100° C. of the polymer (C) is preferably 1000 to 50,000 $mm^2/s$, more preferably 1000 to 10,000 $mm^2/s$, even more preferably 2000 to 8000 $mm^2/s$.

In the grease composition of one embodiment of the present invention, the number-average molecular weight (Mn) of the polymer (C) is preferably 2,000 to 10,000, more preferably 2,500 to 7,000, even more preferably 2,500 to 5,000.

In the grease composition of one embodiment of the present invention, the weight-average molecular weight (Mw) of the polymer (C) is preferably 2,000 to 1,000,000, more preferably 2,500 to 100,000. When the weight-average molecular weight (Mw) of the polymer (C) is 2,000 or more, the wear resistance of the grease composition can be readily bettered; and when the weight-average molecular weight (Mw) of the polymer (C) is 1,000,000 or less, the pumpability of the grease composition can be readily bettered.

In this description, the number-average molecular weight (Mn) and the weight-average molecular weight (Mw) are polystyrene-equivalent values measured according to gel permeation chromatography (GPC).

Here, the poly(meth)acrylate as mentioned as the polymer (C) is a polymer of a polymerizable monomer that contains a (meth)acrylate monomer represented by the following general formula (1).

(1)

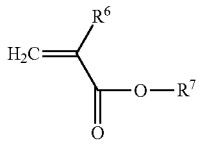

In the general formula (1), $R^6$ represents hydrogen or a methyl group, $R^7$ represents a liner or branched alkyl group having 1 to 200 carbon atoms. $R^7$ is preferably an alkyl group having 1 to 40 carbon atoms, more preferably an alkyl group having 1 to 28 carbon atoms, even more preferably an alkyl group having 1 to 25 carbon atoms.

In the general formula (1), specifically, examples of $R^7$ include a methyl group, an ethyl group, a propyl group, a butyl group, a pentyl group, a hexyl group, a heptyl group, an octyl group, a nonyl group, a decyl group, an undecyl group, a dodecyl group, a trisdecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetracontyl group, a pentatriacontyl group, a hexatriacontyl group, an octatriacontyl group, and a tetracontyl group, and these may be linear or branched.

The polyolefin exemplified as the polymer (C) includes a homopolymer or a copolymer of an olefin having 2 to 20 carbon atoms.

The olefin having 2 to 20 carbon atoms includes ethylene, propylene, 1-butene, 2-butene, 3-methyl-1-butene, 4-phenyl-1-butene, 1-pentene, 3-methyl-1-pentene, 4-methyl-1-pentene, 3,3-dimethyl-1-pentene, 3,4-dimethyl-1-pentene, 4,4-dimethyl-1-pentene, 1-hexene, 4-methyl-1-hexene, 5-methyl-1-hexene, 6-phenyl-1-hexene, 1-octene, 1-decene, 1-dodecene, 1-tetradecene, 1-pentadecene, 1-hexadecene, 1-heptadecene, 1-octadecene, 1-nonadecene, and 1-eicosene.

Specific examples of the polyolefin include polypropylene, polybutene, polypentene, polymethylpentene, and ethylene-propylene copolymer. Among these, polybutene is preferred.

Organic Zinc Compound (D)

The grease composition of one embodiment of the present invention preferably contains an organic zinc compound (D).

Containing an organic zinc compound (D), the wear resistance under poor lubrication conditions of the grease composition can better further.

In the grease composition of one embodiment of the present invention, from the viewpoint of more bettering the wear resistance under poor lubrication conditions of the grease composition, the content of the organic zinc compound (D) is, based on the total amount (100% by mass) of the grease composition, preferably 1.5 to 10% by mass, more preferably 1.5 to 5% by mass, even more preferably 1.5 to 3% by mass, further more preferably 1.5 to 2.5% by mass.

Examples of the organic zinc compound (D) include zinc phosphate, zinc dialkyldithiophosphate (ZnDTP), and zinc dithiocarbamate (ZnDTC).

One alone or two or more kinds of these may be used either singly or as combined.

Among these, zinc dialkyldithiophosphate (ZnDTP) is preferred.

Examples of the zinc dialkyldithiophosphate (ZnDTP) include compounds represented by the following general formula (2).

(2)

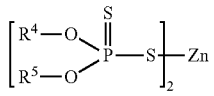

In the general formula (2), $R^4$ and $R^5$ each independently represent a primary or secondary alkyl group having 3 to 22 carbon atoms, or an alkylaryl group substituted with an alkyl group having 3 to 18 carbon atoms.

Here, the primary or secondary alkyl group having 3 to 22 carbon atoms includes a propyl group, a butyl group, a pentyl group, a hexyl group, a heptyl group, an octyl group, a nonyl group, a decyl group, a dodecyl group, a tetradecyl group, a hexadecyl group, an octadecyl group and an eicosyl group that are primary or secondary. Examples of the alkylaryl group substituted with an alkyl group having 3 to 18 carbon atoms include a propylphenyl group, a pentylphenyl group, an octylphenyl group, a nonylphenyl group and a dodecylphenyl group.

In the case where a zinc dialkyldithiophosphate (ZnDTP) is used, one alone or plural kinds of the compound represented by the above-mentioned general formula (2) can be used either singly or as combined.

Extreme Pressure Agent (E)

The grease composition of one embodiment of the present invention preferably contains one or more extreme pressure agents (E) selected from a nonmetallic sulfur compound (E1) and a nonmetallic sulfur-phosphorus compound (E2).

Containing an extreme pressure agent (E), the wear resistance under poor lubrication conditions of the grease composition can further better.

In the grease composition of one embodiment of the present invention, from the viewpoint of more bettering the wear resistance under poor lubrication conditions of the grease composition, the content of the extreme pressure agent (E) is, as a sulfur atom-equivalent amount of the extreme pressure agent (E) and based on the total amount (100% by mass) of the grease composition, preferably 0.4 to 10% by mass, more preferably 0.4 to 5% by mass, even more preferably 0.4 to 3% by mass, further more preferably 0.5 to 1% by mass.

In the grease composition of one embodiment of the present invention, examples of the nonmetallic sulfur compound (E1) include sulfurized oils and fats, sulfurized fatty acids, sulfurized esters, sulfurized olefins, monosulfides, polysulfides, dihydrocarbyl polysulfides, thiadiazole compounds, alkylthiocarbamoyl compounds, thiocarbamate compounds, thioterpene compounds, and dialkylthio dipropionate compounds.

One alone or two or more of these may be used either singly or as combined.

In the grease composition of one embodiment of the present invention, examples of the nonmetallic sulfur-phosphorus compound (E2) include monothiophosphates, dithiophosphates, trithiophosphates, monothiophosphate amine bases, dithiophosphate amine salts, monothiophosphites, dithiophosphites, and trithiophosphites.

One alone or two or more of these may be used either singly or as combined.

In the grease composition of one embodiment of the present invention, one or more of the compound group exemplified as a nonmetallic sulfur compound (E1) and one or more of the compound group exemplified as a nonmetallic sulfur-phosphorus compound (E2) can be used as combined.

The extreme pressure agent (E) may be a package additive containing one or more selected from a nonmetallic sulfur compound (E1) and a nonmetallic sulfur-phosphorus compound (E2).

In the grease composition of one embodiment of the present invention, from the viewpoint of more bettering the wear resistance under poor lubrication conditions of the grease composition, the content of the extreme pressure agent (E) is preferably so controlled as to fall within the above-mentioned range as a sulfur atom-equivalent amount thereof. Specifically, the content is preferably 1 to 4% by mass, more preferably 1 to 3% by mass, even more preferably 1.5 to 2.5% by mass.

Other Additives

The grease composition of one embodiment of the present invention can contain any other additive than the components (A), (B), (C), (D) and (E) that can be blended in ordinary grease compositions, within a range not detracting from the advantageous effects of the present invention.

Examples of such additives include an antioxidant, a rust inhibitor, a detergent dispersant, a corrosion inhibitor and a metal deactivator.

One kind alone or two or more kinds of these additives may be used either singly or as combined.

Antioxidant

Examples of the antioxidant include amine-based antioxidants such as alkylated diphenylamines, phenyl-α-naphthylamines, and alkylated α-naphthylamines; and phenol-based antioxidants such as 2,6-di-t-butyl-4-methylphenol, and 4,4'-methylenebis(2,6-di-t-butylphenol).

Rust Inhibitor

Examples of the rust inhibitor include sorbitan fatty acid esters and amine compounds.

Detergent Dispersant

Examples of the detergent dispersant include ashless dispersants such as succinimides, and boron-based succinimide.

Corrosion Inhibitor

Examples of the corrosion inhibitor include benzotriazole compounds and thiazole compounds.

Metal Deactivator

Examples of the metal deactivator include benzotriazole compounds.

Ratio of Organic Zinc Compound (D) to Extreme Pressure Agent (E)

In the grease composition of one embodiment of the present invention, from the viewpoint of more bettering the pump ability of the grease composition and more bettering the wear resistance thereof under poor lubrication conditions, the zinc atom-equivalent content α of the organic zinc compound (D) to the sulfur atom-equivalent content β of the extreme pressure agent (E) [α/β] is preferably 1.8 to 6.6, more preferably 2 to 6, even more preferably 2 to 5, further more preferably 3 to 4.

Content of Atoms

Molybdenum (Mo)

In the grease composition of one embodiment of the present invention, from the viewpoint of preventing working environments from worsening in that the grease composition may blacken and may readily get dirty, the content of the molybdenum compound therein is preferably smaller. Specifically, the molybdenum atom-equivalent content of the molybdenum compound is, based on the total amount of the grease composition, preferably 10% by mass or less, more preferably 5% by mass or less, even more preferably 1% by mass or less, still more preferably 0.5% by mass or less, further more preferably 0.1% by mass or less, still further more preferably less than 0.1% by mass.

Phosphorus (P)

In the grease composition of the present invention, from the viewpoint of more improving wear resistance under poor lubrication conditions and from the viewpoint of preventing metal corrosion, the content of the phosphorus atom therein is preferably 0.05 to 1.0% by mass, more preferably 0.1 to 0.5% by mass, even more preferably 0.1 to 0.4% by mass.

Sulfur (S)

In the grease composition of the present invention, from the viewpoint of more improving wear resistance under poor lubrication conditions and from the viewpoint of preventing metal corrosion, the content of the sulfur atom therein is preferably 0.4 to 10.5% by mass, more preferably 0.4 to 5.5% by mass, even more preferably 0.4 to 3.5% by mass, further more preferably 0.5 to 1.5% by mass.

Zinc (Zn)

In the grease composition of the present invention, from the viewpoint of more improving wear resistance under poor lubrication conditions, the content of the zinc atom therein is preferably 0.05 to 2.0% by mass, more preferably 0.1 to 1.0% by mass, even more preferably 0.1 to 0.5% by mass.

Ratio of Atoms

In the grease composition of the present invention, from the viewpoint of more improving wear resistance under poor lubrication conditions, the ratio of the sulfur atom to the phosphorus atom therein (S/P) is preferably 1 to 10, more preferably 2 to 9, even more preferably 3 to 8, further more preferably 4 to 7.

From the same viewpoint, the ratio of the sulfur atom to the zinc atom in the grease composition (S/Zn) is preferably 1 to 10, more preferably 2 to 9, even more preferably 3 to 8, further more preferably 4 to 7.

Also from the same viewpoint, the ratio of the phosphorus atom to the zinc atom in the grease composition (P/Zn) is preferably 0.1 to 5, more preferably 0.5 to 3, even more preferably 0.5 to 2.

Solid Lubricant

In the grease composition of one embodiment of the present invention, the content of a solid lubricant therein is, based on the total amount of the grease composition, preferably less than 5% by mass, more preferably less than 1% by mass, even more preferably less than 0.1% by mass. When the content of a solid lubricant in the grease composition is less than 5% by mass, the pumpability of the grease composition can be prevented from worsening.

Physical Properties of Grease Composition

In one embodiment of the present invention, the kinematic viscosity at 40° C. of the liquid component of the grease composition is preferably 100 to 500 $mm^2/s$, more preferably 150 to 400 $mm^2/s$, even more preferably 170 to 300 $mm^2/s$, further more preferably 200 to 300 $mm^2/s$. When the kinematic viscosity at 40° C. of the liquid component of the grease composition is 100 $mm^2/s$ or more, the wear resistance of the grease composition can readily improve. When the kinematic viscosity at 40° C. of the liquid component of the grease composition is 500 $mm^2/s$ or less, the pumpability of the grease composition can readily better.

In this description, "liquid component of the grease composition" means a liquid component resulting from centrifugation of the grease composition at room temperature (20° C.).

The grease composition of one embodiment of the present invention preferably has a worked penetration of 200 to 400, more preferably 250 to 350, even more preferably 260 to 340, further more preferably 280 to 320. When the worked penetration is 200 or more, the pumpability of the grease composition can readily better. When the worked penetration is 400 or less, the grease composition can be readily kept greasy.

In this description, the worked penetration of grease means a value measured according to JIS K2220:2013.

The wear resistance of the grease composition of one embodiment of the present invention can be defined, for example, by a wear volume. Specifically, the wear volume in the Falex Test A to be mentioned below is 10 mg or less. In the Falex Test B where dust contamination is presumed, the wear volume is 30 mg or less.

Use of Grease Composition

The grease composition of the present invention can be used, for example, for construction machines for use in construction sites or for mining machines for use in mining sites in mines.

A construction machine or a mining machine is equipped with a slewing mechanism for swirling an upper revolving superstructure on a frame that connects right and left lower traveling bodies. In the slewing mechanism, a lubrication route is narrow and great rolling slip occurs therein during operation often to cause poor lubrication. In addition, in construction sites, especially in mining sites in mines, powdery dust may often mix in grease to detract from exudation of base oil from grease, therefore readily providing a state of poorer lubrication.

The grease composition of the present invention can exhibit excellent wear resistance even in such poor lubrication conditions, and therefore can be especially favorably used in the above-mentioned clewing mechanism in construction machines or mining machines.

Specifically, the grease composition of the present invention can be used, for example, for construction machines or mining machines having a machine body mass of 200 tons or more, preferably construction machines or mining machines of 300 tons or more, more preferably construction machines or mining machines of 400 tons or more, even more preferably construction machines or mining machines of 500 tons or more. When the machine body mass increases more, the lubrication route therein tends to be narrower and longer by design, and a larger rolling slip may occur during operation to more readily cause poor lubrication, but using the grease composition of the present invention, good wear resistance can be realized even under such poor lubrication conditions.

The machine body mass means a total mass of right and left lower traveling bodies, a frame to connect the right and left lower traveling bodies, and an upper revolving superstructure.

In general, construction machines and mining machines are equipped with a centralized lubrication system. A centralized lubrication system is a device that timely feeds an appropriate amount of a grease composition to one or more slewing mechanisms via a pump or the like, and is located on a large-size hydraulic shovel, etc. It is extremely important that a grease composition smoothly flow in a pipeline of a centralized lubrication system (that is, a grease composition is excellent in pumpability). The grease composition of the present invention has good pumpability and therefore can be favorably used in construction machines or mining machines such as large-size hydraulic shovels equipped with a centralized lubrication system.

Production Method for Grease Composition

As a production method for the grease composition of the present invention, there can be mentioned a production method including the following steps (1) and (2).

Step (1): A step of mixing a mixed base oil (A) and a lithium-based thickener (B) followed by greasing the resultant mixture.

Step (2): A step of mixing a polymer (C) into the composition obtained in the previous step (1).

A lithium-based thickener (B) may be synthesized during the process of the step (1).

For example, a lithium-based thickener (B) may be produced by adding a carboxylic acid and lithium hydroxide into a mixed base oil (A) and saponifying them in the mixed base oil (A) to produce a lithium-based thickener (B).

In the step (1), preferably, a mixed base oil (A) and a lithium-based thickener (B) are sufficiently mixed by stirring with a stirrer or the like.

The temperature in mixing is not specifically limited but is preferably 90 to 110° C.

After a mixed base oil (A) and a lithium-based thickener (B) have been fully mixed, preferably, these are kept at a predetermined temperature for a predetermined period of time. For example, in the case where a lithium-based thickener (B) is used, preferably, these are kept at 100 to 120° C. for 30 to 90 minutes.

In the step (2), preferably, the composition obtained in the step (1) is fully mixed with a polymer (C) by stirring with a stirrer or the like.

In the step (2), an organic zinc compound (D) and an extreme pressure agent (E) mentioned above, and further the above-mentioned general-purpose additives may be mixed in the composition.

EXAMPLES

Next, the present invention is described in more detail with reference to Examples, but the present invention is not whatsoever restricted by these Examples.

Measurement and Evaluation

The grease compositions of Examples 1 to 3 and Comparative Example 1 were measured and evaluated in the manner mentioned below. The results are shown in Table 1.

Kinematic Viscosity at 40° C. of Base Oil and Liquid Component of Grease Composition According to JIS K2283:2000, the kinematic viscosity at 40° C. of the base oils 1 to 3 used in Examples and Comparative Example was measured.

In addition, the kinematic viscosity at 40° C. of the liquid component of the grease compositions of Examples 1 to 3 and Comparative Example 1 was measured.

Worked Penetration

According to JIS K2220:2013, the worked penetration of the grease compositions of Examples 1 to 3 and Comparative Example 1 was measured.

Apparent Viscosity

According to JIS K2220:2013, the apparent viscosity at −10° C. of the grease compositions of Examples 1 to 3 and Comparative Example 1 was measured at a shear rate of 10 $s^{-1}$.

Content of Atoms

According to ASTM D4951, the content of a phosphorus atom, a sulfur atom and a zinc atom in the grease compositions of Examples 1 to 3 and Comparative Example 1 was measured.

Pump Ability Test

A grease composition was filled in a syringe having a cylindrical structure (Luer Lock Syringe: volume 10 mL). Then, the grease composition was extruded out at room temperature and under a pressure of 4 bar for 5 seconds, and the amount of the thus-extruded grease composition (g) was measured.

The case where the amount of the extruded grease composition was 4.5 g or more was evaluated as a rank "a", and the case where the amount was less than 4.5 g was evaluated as a rank "b".

Falex Test A

According to ASTM D2670-2016 and using a Falex tester, a grease composition was tested in a wear test under the following experimental conditions to thereby evaluate the wear resistance of the grease composition.

Pin material: SCM440

Block material: SCM415

Slide rate: 60 minis (180 rpm)

Contact pressure: 430 MPa (300 N)

Temperature=room temperature

Evaluation time: One cycle contains 3 minutes operation and 1 minute halt, and each sample was tested for 27 cycles.

Wear resistance was evaluated by the wear volume (weight loss) of pin before and after the test.

0.2 mL of a grease composition was applied to the contact interface between pin and block, and evaluated.

A case where the wear amount was 10 mg or less was evaluated as a rank "a", and a case where the wear amount was more than 10 mg was evaluated as a rank "b".

Falex Test B

Iron powder, mud (loamy layer of the Kanto district, JIS Z8901-7) and water were added to a grease composition to be in an amount of 2% by weight, 15% by weight and 10% by weight respectively to prepare a contaminated sample. Using a Falex tester, the wear resistance of the grease composition was evaluated according to the same test as that of the Falex test A. 0.2 mL of the grease composition was applied to the contact interface between pin and block, and evaluated.

A case where the wear amount was 30 mg or less was evaluated as a rank "a", and a case where the wear amount was more than 30 mg was evaluated as a rank "b".

Production or Preparation of Grease Composition

The base oil, the thickener and the polymer used in Examples 1 to 3 and Comparative Example 1 are shown below.

Base Oil

Base oil 1: Mineral oil (40° C. kinematic viscosity 31 $mm^2/s$, corresponding to low-viscosity base oil (A1))

Base oil 2: Mineral oil (40° C. kinematic viscosity 91 $mm^2/s$, comparative base oil)

Base oil 3: Mineral oil (40° C. kinematic viscosity 409 $min^2/s$, corresponding to high-viscosity base oil (A2))

Thickener

Simple lithium soap formed of starting materials, 12-hydroxystearic acid and lithium hydroxide.

Polymer

Polybutene (number-average molecular weight: 2900, kinematic viscosity at 100° C.: 4,300 $mm^2/s$)

The kinematic viscosity at 100° C. is a value measured according to JIS K2283.

The number-average molecular weight is a polystyrene-equivalent value measured through gel permeation chromatography (GPC).

Example 1

In a grease production pot having a volume of 60 L, 7.7% by mass of 12-hydroxystearic acid was added to a mineral oil of the base oil 1 and the base oil 3, and heated up to 90° C. with stirring to prepare a base oil containing 12-hydroxystearic acid dissolving therein.

Next, an aqueous solution prepared by dissolving 1.0% by mass of lithium hydroxide (monohydrate) was added to and mixed with the base oil containing 12-hydroxystearic acid dissolving therein, and heated up to 100° C. to evaporate and remove water.

After removal of water, this was heated up to 200° C. to further continue the reaction thereof with stirring. After the reaction, this was cooled from 200° C. down to 80° C. at a cooling rate of 0.1° C./min, and then polybutene and additives were added and mixed. Subsequently, this was milled twice with a three-roll unit to give a grease composition of Example 1.

Example 2

A grease composition of Example 2 was produced in the same manner as in Example 1 except that the blending ratio of the base oil 1 and the base oil 3 was changed as in Table 1.

Example 3

A grease composition of Example 3 was produced in the same manner as in Example 1 except that the blending ratio of the base oil 1 and the base oil 3 was changed as in Table 1.

Comparative Example 1

A grease composition of Comparative Example 1 was produced in the same manner as in Example 1 except that the base oil 1 was changed to the base oil 2, that the blending ratio of the base oil 2 and the base oil 3 was changed as in Table 1, and that the polymer (polybutene) was not added.

TABLE 1

| | | | Example 1 | Example 2 | Example 3 | Comparative Example 1 |
|---|---|---|---|---|---|---|
| Composition | Base oil 1 | 40° C. kinematic viscosity: 31 $mm^2/s$ | 43.3 | 47.3 | 26 | — |
| | Base oil 2 | 40° C. kinematic viscosity: 91 $mm^2/s$ | — | — | — | 20 |
| | Base oil 3 | 40° C. kinematic viscosity: 409 $mm^2/s$ | 30 | 26 | 47.3 | 63.3 |
| | Polybutene | 100° C. kinematic viscosity: 4,300 $mm^2/s$ | 10 | 10 | 10 | — |
| | Thickener | Li simple substance | 8.7 | 8.7 | 8.7 | 8.7 |
| | Extreme pressure agent | butene sulfide | 2 | 2 | 2 | 2 |
| | Organic zinc compound | ZnDTP | 2 | 2 | 2 | 2 |
| | Other additives | | 4 | 4 | 4 | 4 |
| | Total | | 100 | 100 | 100 | 100 |
| Physical Properties | 40° C. Kinematic viscosity | $mm^2/s$ | 219 | 189 | 194 | 280 |
| | Worked penetration | — | 270 | 337 | 289 | 305 |
| | Apparent viscosity | mPa · s | 127 | 107 | 199 | 298 |
| Evaluation | Pumpability test | | a | a | a | b |
| | Falex test A | | a | a | a | b |
| | Falex test B | | a | a | a | b |

In the grease compositions of Examples 1 to 3 and Comparative Example 1, 2% by mass of an organic zinc compound, 2% by mass of an extreme pressure agent and 4% by mass of other additives were blended.

The organic zinc compound was zinc dialkyldithiophosphate (ZnDTP).

The extreme pressure agent was buten sulfide (sulfur atom content: 30% by mass).

The other additives was an antioxidant and a metal deactivator.

The phosphorus atom content in the grease composition was 0.181% by mass, the sulfur atom content therein was 0.934% by mass and the zinc atom content therein was 0.198% by mass.

In Table 1, the unit of the content of the base oils 1 to 3, the polybutene and the thickener was "% by mass" like that of the organic zinc compound, the extreme pressure agent and the other additives.

In Table 1, the 40° C. kinematic viscosity is a 40° C. kinematic viscosity of the liquid component of the grease composition.

The content ratio of the low-viscosity base oil (A1) to the high-viscosity base oil (A2) [(A1)/(A2)] was 1.4 in Example 1, 1.8 in Example 2, 0.54 in Example 3, and 0 in Comparative Example 1.

From the results in Table 1, it is known that the grease compositions of Examples 1 to 3 are excellent in pump ability and wear resistance and are also excellent in wear resistance even under poor lubrication conditions. In particular, since these are excellent even in the Falex test B, it is known that in these grease compositions, exudation of the base oil from them can sufficiently occurs even in environments where much dusty powder may form such as mining sites, and therefore these grease compositions can exhibit excellent wear resistance in such environments.

As opposed to this, it is known that the grease composition of Comparative Example 1 does not contain a polymer (polybutene) and has an apparent viscosity of more than 250 mPa·s, and is therefore poor in pumpability and wear resistance in poor lubrication conditions.

The invention claimed is:

1. A method, comprising employing a grease composition in a slewing mechanism of a construction machine equipped with a centralized lubrication system or a mining machine equipped with a centralized lubrication system, wherein the grease composition comprises:

(A) a mixed base oil comprising (A1) a low-viscosity base oil having a kinematic viscosity at 40° C. of 10 to 50 $mm^2/s$ and (A2) a high-viscosity base oil having a kinematic viscosity at 40° C. of 200 to 700 $mm^2/s$;

(B) a lithium-based thickener; and (C) a polymer having a kinematic viscosity at 100° C. of 1,000 to 100,000 $mm^2/s$, wherein the grease composition has an apparent viscosity of 50 to 250 mPa·s at −10° C., as measured according to JIS K2220:2013 and at a shear rate of 10 $s^{-1}$, and wherein the polymer (C) is chemically distinct from the mixed base oil (A).

2. The method according to claim 1, wherein a content ratio of the low-viscosity base oil (A1) to the high-viscosity base oil (A2) [(A1)/(A2)] is from 1/5 to 10/1.

3. The method according to claim 1, wherein a content of the polymer (C) is, based on a total amount of the grease composition, from 1 to 20% by mass.

4. The method according to claim 1, wherein the grease composition further comprises an organic zinc compound (D).

5. The method according to claim 1, wherein the grease composition further comprises one or more extreme pressure agents (E) selected from the group consisting of a nonmetallic sulfur compound (E1) and a nonmetallic sulfur-phosphorus compound (E2).

6. The method according to claim 5, wherein the extreme pressure agent (E) is one or more selected from:

at least one nonmetallic sulfur compound (E1) selected from the group consisting of sulfurized oils and fats, sulfurized fatty acids, sulfurized esters, sulfurized olefins, monosulfides, polysulfides, dihydrocarbyl polysulfides, thiadiazole compounds, alkylthiocarbamoyl compounds, thiocarbamate compounds, thioterpene compounds, and dialkylthio dipropionate compounds, and at least one nonmetallic sulfur-phosphorus compound (E2) selected from the group consisting of monothiophosphates, dithiophosphates, trithiophosphates, monothiophosphate amine bases, dithiophosphate amine salts, monothiophosphites, dithiophosphites, and trithiophosphites.

7. The method according to claim 1, wherein a content of the thickener (B) is, based on a total amount of the grease composition, from 0.5 to 25% by mass.

8. The method according to claim 1, wherein a kinematic viscosity at 40° C. of the liquid component of the grease composition is from 100 to 500 $mm^2/s$.

9. The method according to claim 1, wherein the grease composition has a worked penetration at 25° C. of 200 to 400.

10. The method according to claim 1, wherein the grease composition has an apparent viscosity of 100 to 200 mPa·s at −10° C., as measured according to HS K2220:2013 and at a shear rate of 10 $s^{-1}$.

11. The method according to claim 1, wherein a content of the polymer (C) is, based on a total amount of the grease composition, from 5 to 12% by mass.

* * * * *